United States Patent [19]

Elsworth

[11] 4,014,629

[45] Mar. 29, 1977

[54] PUMP FOR PUMPING BOTH LOW VISCOSITY AND HIGH VISCOSITY FLUIDS

[75] Inventor: Robert M. Elsworth, Loudonville, N.Y.

[73] Assignee: General Electric Company, Waterford, N.Y.

[22] Filed: Jan. 5, 1976

[21] Appl. No.: 646,320

[52] U.S. Cl. ..... 417/259; 417/510; 417/514; 417/520

[51] Int. Cl.[2] ..... F04B 7/00

[58] Field of Search ..... 417/259, 260, 266, 510, 417/514, 520

[56] References Cited

UNITED STATES PATENTS

| | | | |
|---|---|---|---|
| 2,627,814 | 2/1953 | Davis | 417/259 |
| 3,121,292 | 2/1964 | Butler et al. | 46/74 B |

*Primary Examiner*—Carlton R. Croyle
*Assistant Examiner*—G. P. LaPointe
*Attorney, Agent, or Firm*—John L. Young; E. Philip Koltos; Frank L. Neuhauser

[57] ABSTRACT

An improved pump for pumping both low viscosity and high viscosity fluids, which contains therein a body with three cavities, a hollow cylinder fitting in the first cavity and attached at its lower end, a hollow cylinder head containing therein a first valve means; having in the second cavity of said body of said pump a second valve means with a shaft positioned at the top end of said hollow cylinder such that said first valve means and said second valve means are positioned to ride freely on said shaft. Finally, a kick plate means positioned at the end of said shaft and located such that it can move freely within said third cavity means. When the pump is pumping high viscosity fluids it is the function of the kick plate means to push or force the high viscosity fluid up from said third cavity into the second cavity and then through the hollow cylinder head into the first cavity means and out through the outlet means in said pump. The kick plate means does not affect the efficiency of the pump when it is pumping low viscosity fluids.

11 Claims, 6 Drawing Figures

PUMP FOR PUMPING BOTH LOW VISCOSITY AND HIGH VISCOSITY FLUIDS

BACKGROUND OF THE INVENTION

The present invention relates to pumps and more specifically relates to an improved pump capable of pumping fluids that may have a viscosity varying from 1 to 1 million centipoise at 25° C. Pumps for pumping low viscosity or high viscosity fluids are well known in the art.

However, in the past, pumps were built for pumping either low viscosity fluids or for pumping high viscosity fluids. Accordingly, in a process operation when a low viscosity pump was utilized to pump a low viscosity fluid and it became necessary in the process operation to pump a higher viscosity fluid, it was necessary to take out the low viscosity pump and place a high viscosity pump in the line. Accordingly, it was highly desirable to have a versatile pump which could pump both low viscosity fluids and high viscosity fluids that is, fluids having a viscosity varying from 25 to 1 million centipoise at 25° C, without changing the pump or making any mechanical adjustments to the pump.

In this respect, it was known in the construction of high viscosity pumps that the use of a kick plate means, or a plate at the end of the piston shaft could be utilized which would force or help to force the high viscosity fluid through the pump.

There were two disadvantages with such high viscosity pumps. First of all, all such pumps did not pump fluid continually on both strokes of the pump piston or pump cylinder.

Another disadvantage was they were completely inapt for pumping low viscosity material or would pump low viscosity fluids only with difficulty and with very little efficiency.

With respect to low viscosity hydraulic pumps it was known in these pumps to use spherical balls as the valve means. These pumps, as can be envisioned, did not utilize kick plate means or a kick plate at the end of the cylinder shaft for forcing the fluid through the pump.

However, more importantly, these low viscosity hydraulic pumps were unsuitable for pumping high viscosity fluids as the round spherical balls that were utilized as the valve means permitted the passage of high viscosity materials through the valves only with difficulty and with very little efficiency in the pump operation.

In short, while such valve means, comprising spherical balls, were sufficient for the pumping of low viscosity fluids, that is, in the neighborhood of 1 to 10,000 centipoise at 25° C, when such low viscosity hydraulic pumps were utilized to pump high viscosity fluids the pumping action was completely inefficient. Accordingly, such valve means composed of round spherical balls were completely unsuited to the pumping of the high viscosity fluids, such fluids having a viscosity in the neighborhood of 100,000 to 1 million centipoise at 25° C.

Accordingly, it is one object of the present invention to provide for an improved pump which can pump both low viscosity and high viscosity fluids without any mechanical adjustments.

It is another object of the present invention to provide for an improved pump for pumping both low viscosity and high viscosity fluids continually on both strokes of the pump piston or cylinder.

It is an additional object of the present invention to provide for an improved pump for pumping both low viscosity and high viscosity fluids with a novel kick plate means for forcing high viscosity fluids through the pump when such pump is pumping high viscosity fluids, but which does not interfere with the pumping of low viscosity fluids by the same pump.

It is yet an additional object of the present invention to provide for an improved pump which has new and improved valve means in the pump which do not deter from the efficiency of the pump for pumping low viscosity fluids and which impart to the pump an improved pumping capacity for the pumping of high viscosity fluids.

In the accompanying drawings.

Figures 1, 2, 3, 4, 5, 6:
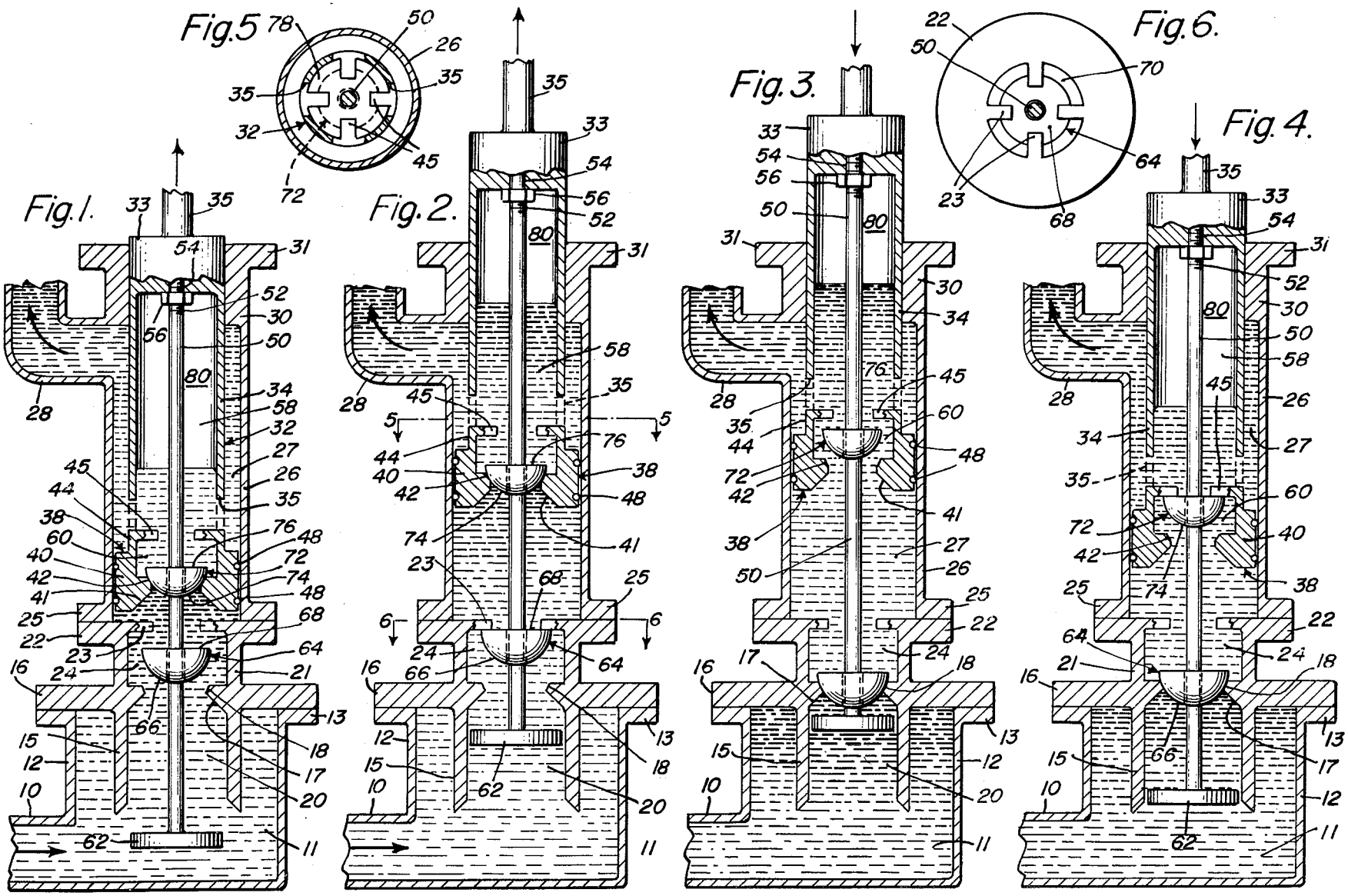
FIG. 1 is a side view of the pump of the instant invention when the hollow cylinder or piston of the pump is ready to begin its upward stroke.
FIG. 2 is a side view of the same as FIG. 1, but with the pump about to complete its upward stroke.
FIG. 3 is the same as FIG. 1, but with the pump beginning its downward stroke.
FIG. 4 is the same as FIG. 1, but with the pump reaching completion of its downward stroke.
FIG. 5 is a cross-sectional view along line 5—5 of FIG. 2, showing the first valve means in a view perpendicular to the side view of FIG. 2.
FIG. 6 is a cross-sectional view along line 6—6 of FIG. 2 showing in detail the second valve means in a view perpendicular to the side view of FIG. 2.

Accordingly, the above objects of the present invention are accomplished by means of the disclosure set forth hereinbelow.

SUMMARY OF THE INVENTION

Accordingly, there is provided by the present invention, an improved pump for pumping fluids with a viscosity varying from 1 to 1 million centipoise at 25° C without any mechanical adjustments comprising a body having therein a first cavity, a second cavity connected to said first cavity, and a third cavity connected to said second cavity, a hollow cylinder with a closed end and an open end positioned within said first cavity such that said open end is connected to a hollow cylinder head with a fourth cavity therein, a shaft having a first end and a second end and connected at said first end to said closed end of said hollow cylinder said shaft passing through the first, second, third and fourth cavities, first valve means positioned about the said shaft and positioned to move in said fourth cavity, a second valve means positioned about such said shaft and positioned to move in such second cavity and kick plate means connected to said second end of such shaft positioned to move within said third cavity.

The kick plate means is a flat plate which desirably is constructed and has such dimensions that it will pass in close proximity to the walls of the third cavity and such that it is positioned and affixed perpendicular to the shaft. The purpose of the kick plate means is to force viscous fluid from the inlet means of the pump through the third cavity into the second cavity. The fluid is then forced from the second cavity to the hollow cylinder head and out the outlet means of the pump by the suction and pumping action created by the pump.

The other novel aspect of the pump of the instant case is the novel valve means that are utilized. Both the first valve means and the second valve means are composed of half of spherical balls which can rest on a first valve seat in the hollow cylinder head or in a second valve seat in the second cavity to stop the passage of fluid in certain instances, as will be explained hereinbelow, but can move and float or be positioned against the rest means at the upper portion of the hollow cylinder head or the upper portion of the body of the pump defining the second cavity and allow the passage of even very viscous fluids to pass through the pump with facility.

An important aspect of the present pump which can pump both low viscosity and high viscosity fluids is that it will continually pump fluids both on the downward stroke of the cylinder as well as in the upward stroke of the cylinder.

An important aspect of the instant valve means of the pump of the instant case is that it can pump low viscosity fluids with equal facility as high viscosity fluids, that is, low viscosity fluids having a viscosity in the range of 1 to 10,000 centipoise at 25° C.

It should be mentioned at this point that the instant pump was devised for the pumping of silicone fluids, that is, silicone fluids having a viscosity of anywhere from 50 to 10,000 centipoise at 25° C or the pumping of high viscosity silicone compositions such as uncured room temperature vulcanizable silicone rubber compositions having a viscosity in the neighborhood of anywhere from 100,000 to 1 million centipoise at 25° C.

DESCRIPTION OF THE PREFERRED EMBODIMENT

Considering FIG. 1, the fluid enters the pump through conduit 10 into basin 11 having walls 12 and flanges 13. The base of the pump is positioned in basin 11. The base of the pump has walls 15 with upper flanges 16 resting on flanges 13 of basin 11. Flanges 16 and flanges 13 may be connected together by any suitable means as is well known in the art.

At the base of the pump, in addition to walls 15 and flanges 16, there is present shoulder 17 leading to valve seat area 18. Valve seat area 18, shoulder 17 and walls 15 define cavity 20. Appended to flanges 16 and shoulder 17 there are walls 21, flanges 22 (appended to walls 21) and resting prongs 23 which are connected to flanges 22. Valve seat area 18, shoulder 21 and resting prongs 23 define cavity 24. On flanges 22, there rests flanges 25, walls 26 which form the main chamber of cavity 27 of the pump.

At the upper portion of walls 26 there is outlet elbow 28 out of which the pumped fluid emerges and goes on into whatever pipe lines it is channeled into.

At the upper portion of cavity 27, walls 26 thicken into a more constricted channel to form walls 30 with flanges 31. Flanges 25 which rest on flanges 22 are connected by whatever suitable means it is desired as is well known in the are in the construction of pumps.

In cavity 27, within walls 26 and 30, rides a hollow cylinder 32 with a solid upper portion 33, and a thin wall lower portion 34. The upper solid portion of the hollow cylinder 33 has an arm 35 which is driven by the usual linkage and connected to a motor as is well known in the driving of hydraulic pumps.

Hollow cylinder walls 34 at their lower portion have openings 35 through which the fluid that is being pumped can pass therethrough. These hollow cylinder walls 34 are then connected to hollow cylinder head 38 which comprises a lower portion having walls 40, shoulder 41, valve seat area 42. Walls 40 thin out at the upper portion of the hollow cylinder head to form upper walls 44 to which is attached resting prongs 45. Around the thicker walls 40 of the hollow cylinder head there are two O rings or sealing rings 48 which are well known in the art and which prevent the passage of any of the fluid being pumped from passing between walls 26 of the body of the pump and walls 40 of the hollow cylinder head 38. Attached to the solid portion 33 of the hollow cylinder, there is a shaft 50 which is attached to solid portion 33, through a threaded portion 52 which fits into threaded portion 54 in the solid portion of the hollow cylinder 33 and which is adjusted in its position in relation to the other parts of the pump and tightened in its position by nut 56.

Shaft 50 passes through cavity 58 in the hollow cylinder down through cavity 60 in the hollow cylinder head 38, through cavity 24 in the lower portion of the pump and finally through cavity 20.

Shaft 50 is connected at its extremity to kick plate 62. Kick plate 62 is attached to shaft 50 such that they are preferably perpendicular to each other. Kick plate 62 is at right angles to shaft 50. Desirably, kick plate 62 is designed such that its extremities are in close proximity to walls 15 when moving in cavity 20. The function of kick plate 62 in the situation when high viscosity fluids are being pumped is to propel or force such high viscosity fluids from basin 11 into cavity 20 and through cavity 20 into cavity 24. The valves in the present pump comprise two valves, one valve 64 composed of a lower spherical portion 66 which fits into valve seat 18, so as to prevent passage of fluid and an upper flat portion 68 which can abut resting prongs 23, yet permit fluid to flow therethrough. The means by which this is accomplished, that is, the flowing of the fluid by valve 64 when the flat portion of valve 64 is resting on prongs 23, is better seen in FIG. 6, which indicates that when valve 64 is resting on prongs 23, fluid can pass through the pump through openings 70.

The upper valve 72 comprises a lower spherical portion 74 and an upper flat portion 76, in which the lower spherical portion 74 rests on valve seat 42, preventing the passage of fluid therethrough, but when valve 72 is floating or the flat portion thereof 76 is abutting resting prongs 45, fluid can pass therethrough through openings 78 as can more clearly be seen in FIG. 5.

The upper portion of hollow cylinder 32 is filled with air 80, the purpose of the air being to cushion the pumping action of hollow cylinder 32 such that the flow is more continuous and decreasing any tendency of the pump to pump fluid therethrough in a non-continuous manner. This cushioning air layer 80 also cuts down on the wear of the pump parts since it cushions vibrations and oscillations in the mechanical parts of the pump.

Going from FIG. 1 through 4 in the operation of the pump, fluid comes through conduit 10, is forced up by kick plate 62 through floating valve 64, whether it is floating as in FIG. 1, or abutting resting prongs 23 as in FIG. 2. The fluid is then sucked into cavity 24 by the upward movement of hollow cylinder 32 and cylinder head 38. In this upward movement, valve 72 is resting on valve seat 32 such that fluid cannot pass therethrough. However, the fluid in cavity 27 contained by body walls 26 as well as the fluid in cavity 58 of hollow cylinder 32 is forced by the upward motion of hollow cylinder 32 which is forced through the openings 35 in hollow cylinder 32. Such fluids are forced out through outlet elbow 28. After the hollow cylinder 32 and cylinder head 38 reach their topmost position then hollow cylinder 32 and head 38 begin to descend as in FIG. 3. When hollow cylinder 32 completes its upward motion and then starts downward in its downward cycle as shown in FIGS. 3 and 4, the spherical portion 66 of valve 64 sits on valve seat 18, thus, sealing the passage of any fluid therethrough.

On the other hand, valve 72 first floats and then the flat portion 76 comes to rest on resting prongs 45. By the downward motion of hollow cylinder 32, and hollow cylinder head 38 fluid is forced through cavities 60 and 58 through openings 35 in hollow cylinder head 32 and through cavity 27 out the outlet elbow 28.

This completes a description of the working of the pump of the instant case.

It is only necessary to add that the novel means of utilizing a kick plate at the end of shaft 50 in the instant case permits the utilization of the instant pump with the pumping of very high viscosity materials such as, in the area of 100,000 to 1 million centipoise at 25° C, while also being suitable at the same time for pumping low viscosity materials having viscosities as low as 1 centipoise at 25° C.

In addition, the novel valves of the instant case permit the pumping of high viscosity materials with efficiency. The semi-spherical ball valves of the instant case permit high viscosity materials to be pumped through such valves with facility and efficiency in a continuous manner and with the same capability as is the case when the pump is used for low viscosity fluids.

Another advantage of the instant pump over the prior art is that the semi-spherical balls which comprise the valve means are positioned about shaft 50 such that they can move freely on said shaft in an upward or downward direction but are guided in accurately resting against rest prongs 23, 45 on seating in valve seats 18, 42.

In the prior art pumps, the ball valves which were entirely spherical were not positioned about a main shaft so as to be guided in their movement such that their resting on the resting prongs or in the valve seats was erratic at best. This type of valve construction of the prior art pumps for low viscosity fluids would especially cause difficulties and loss of efficiency if they were to be utilized to pump high viscosity fluids.

I claim:

1. An improved pump for pumping fluids with a viscosity ranging from 1 to 1 million centipoise at 25° C without any mechanical adjustments comprising a body having therein a first cavity, a second cavity connecting to said first cavity and a third cavity connecting to said second cavity, a hollow cylinder with a closed end and an open end positioned within said first cavity such that said open end is totally within said first cavity, a cylinder head with a fourth cavity therein connected to the open end of said hollow cylinder, a shaft having a first end and a second end connected to said closed end of said hollow cylinder at its first end and passing through said first, second, third and fourth cavities, a first valve means positioned about said shaft and positioned to move in said fourth cavity, a second valve means positioned about said shaft and positioned to move in said second cavity and kick plate means connected at said second end of said shaft and positioned to move within said third cavity.

2. The pump of claim 1 further including inlet means connected to said body at said third cavity to introduce fluid to said third cavity and outlet means connected to said body at said first cavity in proximity to the closed end of said hollow cylinder.

3. The pump of claim 1 wherein the cylinder head with the fourth cavity therein has resting means for said first valve means adjacent to the cavity in said hollow cylinder which stops said first valve means from moving from said fourth cavity into hollow part of said cylinder but allows fluid to move through said fourth cavity into the hollow part of said cylinder.

4. The pump of claim 3 wherein said cylinder head has a first valve seat means defining said fourth cavity adjacent to said second cavity such that when said first valve means rests thereon no fluid can pass from said second cavity into said fourth cavity.

5. The pump of claim 4 wherein said first valve means comprises half of a spherical ball positioned about said shaft so that it can ride freely thereon such that the spherical part of the ball is positioned such that it can rest in said first valve seat means.

6. The pump of claim 1 wherein said second cavity in said body is defined by resting means for said second valve means located where said second cavity connects to said first cavity which resting means stops said second valve means from moving out said second cavity into said first cavity while permitting fluid to move through said second cavity into said first cavity and said fourth cavity.

7. The pump of claim 6 wherein said second cavity in said body is further defined by second valve seat means located where said second cavity connects to said third cavity such that when said second valve means rests thereon no fluid can pass through said second cavity and third cavity.

8. The pump of claim 7 wherein said second valve means comprises half of a spherical ball positioned about said shaft so that it rides freely thereon such that the spherical part of the ball is positioned such that it can rest in said second valve seat means.

9. The pump of claim 9 wherein said hollow cylinder has an opening therein in proximity to said cylinder head such that the fluid can flow from said hollow cylinder head through said hollow cylinder and said openings into said first cavity and out to said outlet means.

10. The pump of claim 9 wherein said hollow cylinder in proximity to its open end is filled with the fluid to be pumped during operation and that portion of said hollow cylinder in proximity to its closed end is at all times during operation filled with a gas.

11. The pump of claim 10 wherein said kick plate means comprises a flat plate connected perpendicular to the end of said shaft and of such dimensions such that the edges of said flat plate are in close proximity to the walls of said body in said third cavity and such during operation of the pump said flat plate forces the fluid being pumped from said third cavity into said second cavity.

* * * * *